US006857203B2

(12) United States Patent
Minden

(10) Patent No.: US 6,857,203 B2
(45) Date of Patent: Feb. 22, 2005

(54) PLEATLESS BALLET SLIPPER

(75) Inventor: Elizabeth Gaynor Minden, New York, NY (US)

(73) Assignee: Gloria Minden, Inc., New York, NY (US)

( * ) Notice: Subject to any disclaimer, the term of this patent is extended or adjusted under 35 U.S.C. 154(b) by 36 days.

(21) Appl. No.: 10/270,909

(22) Filed: Oct. 15, 2002

(65) Prior Publication Data

US 2003/0070319 A1 Apr. 17, 2003

Related U.S. Application Data

(60) Provisional application No. 60/329,844, filed on Oct. 16, 2001.

(51) Int. Cl.[7] ..... A43B 5/12
(52) U.S. Cl. ..... 36/8.3; 36/9 R; 36/102
(58) Field of Search ..... 36/8.3, 9 R, 88, 36/97, 102, 45

(56) References Cited

U.S. PATENT DOCUMENTS 1,854,642 A * 4/1932 Brodick ..... 36/8.3
1,872,641 A * 8/1932 Capezio ..... 36/8.3
1,953,659 A * 4/1934 Savino ..... 36/8.3
2,110,890 A * 3/1938 Paul ..... 36/8.3
2,619,743 A * 12/1952 Harris ..... 36/8.3
RE33,018 E * 8/1989 Ostrander ..... 36/9.3
5,259,126 A * 11/1993 Rosen ..... 36/93
6,588,124 B2 * 7/2003 Morrone ..... 36/8.3
2003/0121176 A1 * 7/2003 Baruck ..... 36/8.3

* cited by examiner

*Primary Examiner*—M. D. Patterson
(74) *Attorney, Agent, or Firm*—St. Onge Steward Johnston & Reens LLC

(57) ABSTRACT

A substantially pleatless ballet slipper has a non-elastic upper, and an elastic or stretchy toe piece affixed to the forward edge of the upper. The toe piece has a small amount of bunched material at its underside. An outsole is affixed to the toe piece and covers substantially all bunched material or pleats of the toe piece. One or more cushioning pads located on the interior of the slipper make the small amount of bunched material imperceptible to the dancer.

17 Claims, 4 Drawing Sheets

PLEATLESS BALLET SLIPPER

PRIOR APPLICATION

Applicant claims priority benefits under 35 U.S.C. §119 (e) of U.S. Provisional Patent Application Ser. No. 60/329,844 filed Oct. 16, 2001.

FIELD OF THE INVENTION

The present invention relates to footwear and a method of making same. More specifically, the present invention relates to footwear worn by dancers, commonly referred to as ballet slippers.

BACKGROUND OF THE INVENTION

Ballet dancers often wear a soft dance shoe called a ballet slipper. The ballet slipper is different from a hard pointe shoe. The ballet slipper is used for practice and performance. A typical ballet slipper has pleats on the underside of the toe. As shown in FIG. 2, typical prior art ballet slipper 100 has pleats 110 in the toe area of the forefoot that are inevitably irritating and uncomfortable to the performer's feet, impeding balance and preventing the proper articulation of the toes. To minimize the bulkiness of pleats 110 and to obtain even pleating, slipper 100 is constructed using three upper sections 120*a*, 120*b*, and 120*c*. Upper section 120*a* is joined to itself along longitudinal seam 130*a* and to the other two sections along transverse seam 130*b*. Sections 120*b* and 120*c* are joined to each other along seam 130*a*. However, this patchwork is aesthetically undesirable, and further, does not eliminate the pleats.

Another problem of known ballet slippers is that they fail to fit tightly and fail to conform to the toes during the execution of many ballet steps and poses. Loose slippers are unattractive and uncomfortable under many circumstances. Practice ballet slippers have been made entirely of elastic or stretchy material. However, these slippers are not suitable for dance because the slipper does not provide adequate support and protection for the foot during more strenuous performance.

Dancers commonly believe that an absence of pleats greatly enhances feel for the floor, comfort, the ability to turn, to balance, and to properly articulate the toes. Accordingly, it would be desirable to provide a substantially pleatless ballet slipper for performance use, which also provides a desired snug fit and support for the dancer's foot

SUMMARY OF THE INVENTION

In accordance with one embodiment of the present invention, a substantially pleatless ballet slipper is provided. The substantially ballet pleatless slipper comprises an upper made of a supporting material, a toe piece affixed at a first marginal edge to the upper, the toe piece made of elastic or stretchy materials bunched as necessary at a second marginal edge; and a first outsole affixed to the toe piece, the outsole covering substantially all the bunched materials on the outer surface of the slipper. A cushioning pad in the interior of the slipper also covers the bunched materials. The shoe design makes the bunched materials or pleats nearly imperceptible to the dancer.

In accordance with another embodiment of the present invention, a method of making a substantially pleatless ballet slipper is provided. The method of making a substantially pleatless ballet slipper comprises providing an upper; providing a toe piece made of elastic or stretchy material; affixing the toe piece at a first marginal edge to the upper; bunching the toe piece at a second marginal edge; providing a first outsole; and affixing the first outsole at a peripheral margin to the toe piece to cover substantially all bunched material of the toe piece.

While not explicitly described herein, it is intended, and an ordinary person skilled in the art will realize, that such method may further require cementing and/or stitching of footwear pieces to each other. Similarly, it is intended that other means to affix footwear pieces may be used equally effectively and are encompassed by the specification herein.

DETAILED DESCRIPTION OF THE DRAWINGS

Figure 1:
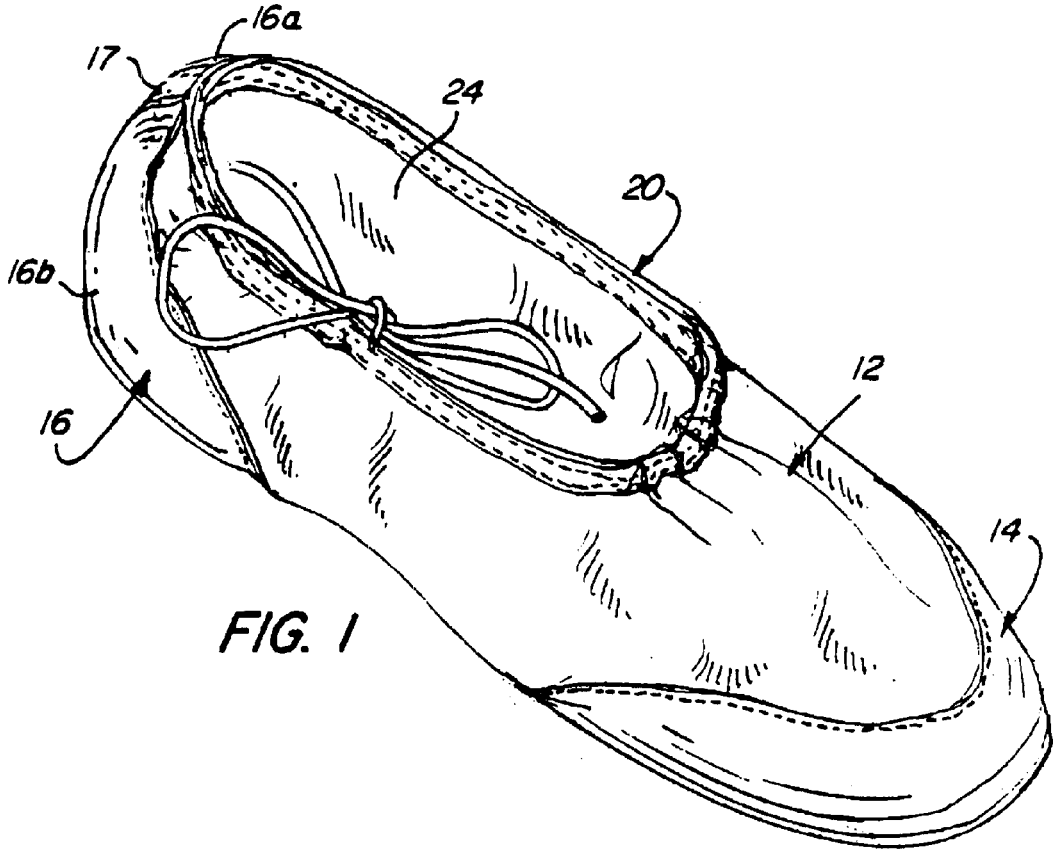
FIG. 1 is an upper perspective view of a substantially pleatless ballet slipper in accordance with one embodiment of the invention.
Figure 6:
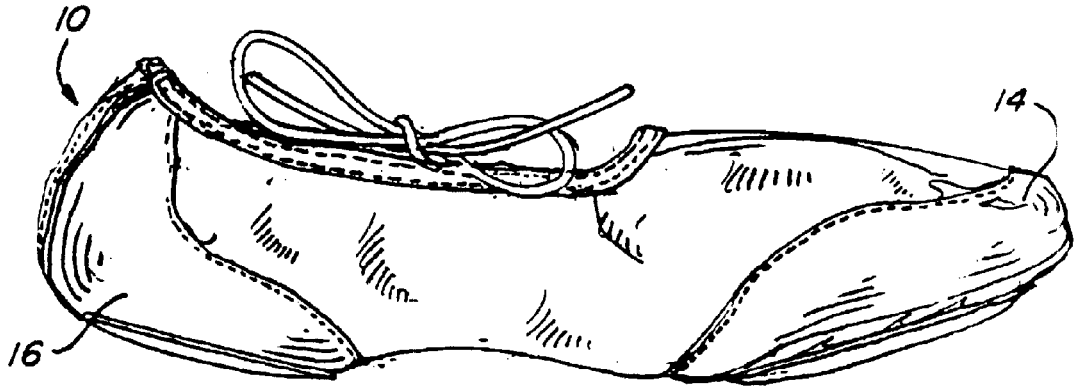
FIG. 6 is a right side elevation view of the substantially pleatless slipper of FIG. 1
Figure 7:
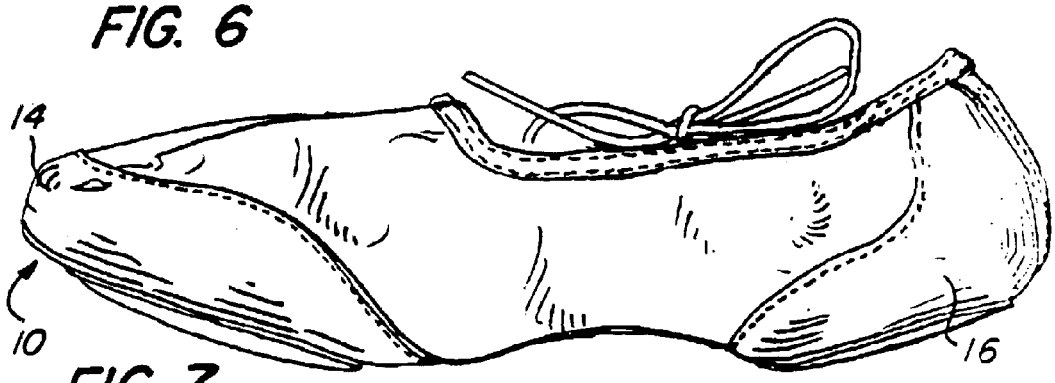
FIG. 7 is a left side elevation view of the substantially pleatless slipper of FIG. 1
Figure 2:
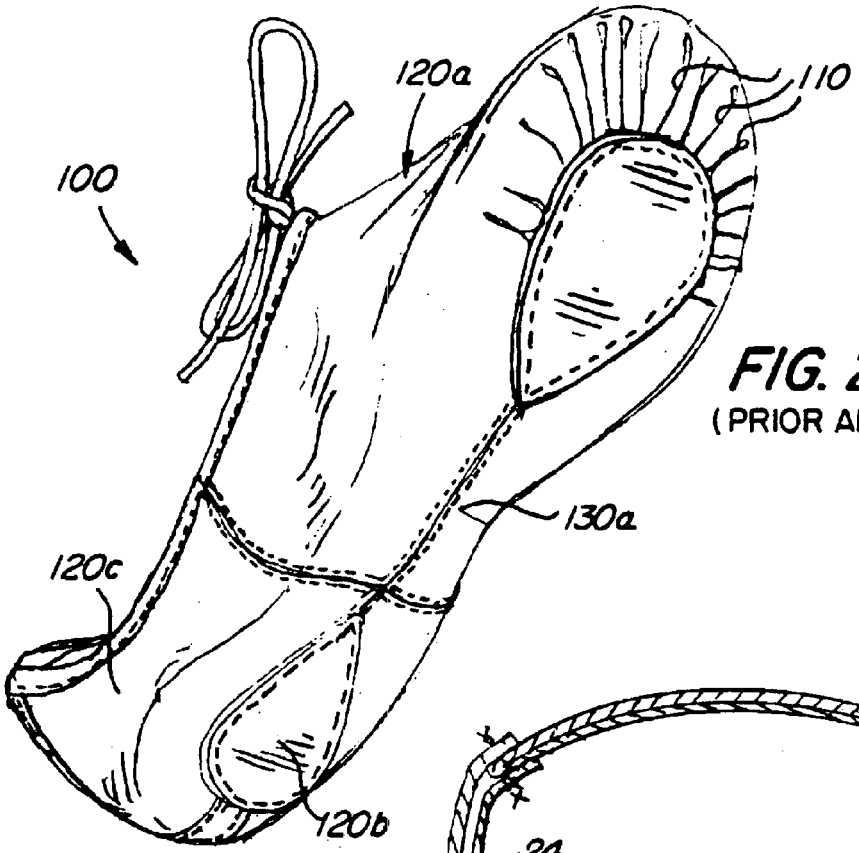
FIG. 2 (PRIOR ART)
FIG. 2 is a lower perspective view of a prior art dance slipper having pleats.
Figure 11:
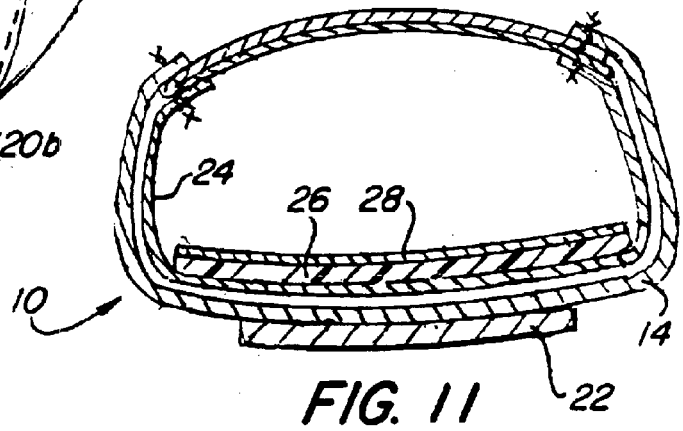
FIG. 11 is an end cross-sectional view of the substantially pleatless slipper of FIG. 1.

The Figures illustrate a substantially pleatless slipper in accordance with the invention as it appears in the unworn state. As the slipper contains fabrics and an elastic in the opening of the upper, it tends to curl up, as will be familiar to anyone who has worn an dance slipper with an elastic around the upper opening. The curled up slipper makes the slipper appear to be somewhat wrinkled and baggy, but this is only how it looks in the unworn state. When the substantially pleatless slipper is worn on a dancers foot, the slipper will be stretched out and snugly fitted to the dancer's foot, giving a sleek appearance to the dancer's foot. In the Figures, the same numbered elements are used in the Figures to identify the same elements.

FIGS. 1 and 3–11 illustrate a pleatless ballet slipper in accordance with one embodiment of the invention. Therein, ballet slipper 10 includes upper 12, toe piece 14, heel piece 16, drawstring 18, and drawstring sleeve 20, which are fastened together to form the ballet slipper 10. Preferably these components are stitched together. Upper 12 may be made from any appropriate woven or non-woven material including suede, leather, canvas or any other fabric or material that suitably contains and supports the dancer's foot. Preferably upper 12 is made of a non-elastic/non-stretchy fabric. Preferably, but not necessarily, upper 12 is a unitary element covering the upper portion, sides, and center bottom of a performer's foot but not all the toe and heel foot area.

Toe piece 14 and heel piece 16 are preferably, but not necessarily, made of an elastic or stretchy material, preferably stretch suede, stretch leather, or any other suitable material and/or fabric which has qualities of being light, pliable, not bulky, and having some "give." Preferably, the toe piece 14 and heel piece 16 include an integral backing fabric. As shown in the preferred embodiment of the figures, toe piece 14 is a unitary exterior slipper element sized to cover the toe, sides and upper, and a portion of the bottom forefoot areas of the dancer not covered by upper 12. Heel piece 16 is an exterior slipper element of two symmetrical shapes 16*a* and 16*b* sized to cover the heel area of the dancer's foot and a rear bottom portion of the dancer's foot. Heel reinforcing piece 17, preferably made of the same material as heel piece 16, covers and strengthens the seam between heel pieces 16*a* and 16*b* in the finished heel piece 16.

Drawstring 18 is an elastic or stretchy cord or other suitable cord, ribbon or a drawstring. Drawstring sleeve 20 is any kind of enclosure suitable to accommodate drawstring 18 which is affixed, preferably, but not necessarily, by stitching, to upper 12.

Figure 3:
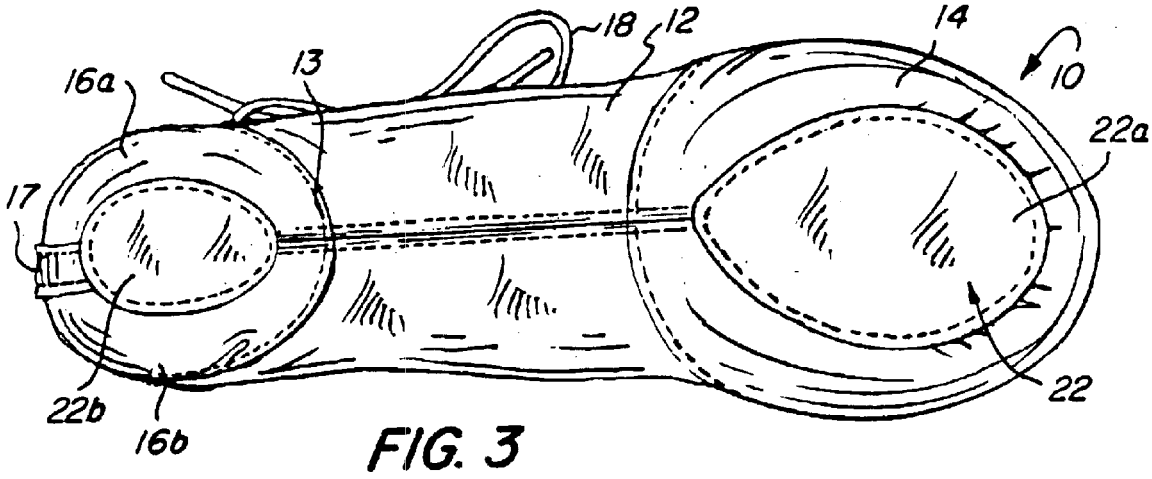
FIG. 3 is a bottom plan view of the substantially pleatless slipper in accordance with FIG. 1 having a two-part outsole.
Figure 9:
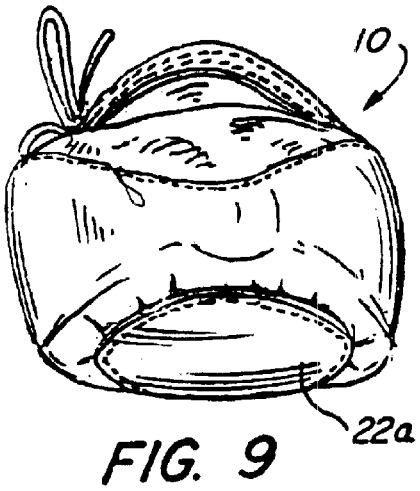
FIG. 9 is a front elevation view of the substantially pleatless slipper of FIG. 1.
Figure 10:
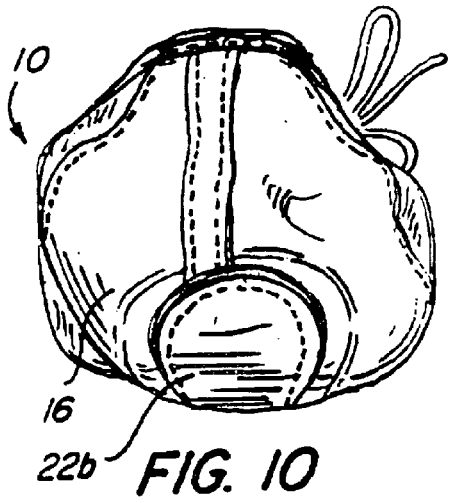
FIG. 10 is a rear elevation view of the substantially pleatless slipper of FIG. 1.

Referring now to FIG. 3, upper 12, toe piece 14, heel pieces 16*a* and 16*b* comprising heel piece 16, heel reinforcing piece 17, and drawstring 18 are seen. Longitudinal seam 13 extends from the forefoot area to the heel area of slipper 10. Outsole 22 includes outsole toe portion 22*a* and outsole heel portion 22*b*, each preferably, but not necessarily, egg-shaped, although any suitable shape may be used. Outsole 22 may be made of any durable material including leather, suede, urethane, or any other suitable material and/or fabric selected to provide appropriate slip resistance. More preferably, outsole 22 is suede. Outsole toe portion 22*a* and heel portion 22*b* are stitched and/or glued to the toe piece 14 and the heel pieces 16*a*, 16*b* respectively.

Figure 4:
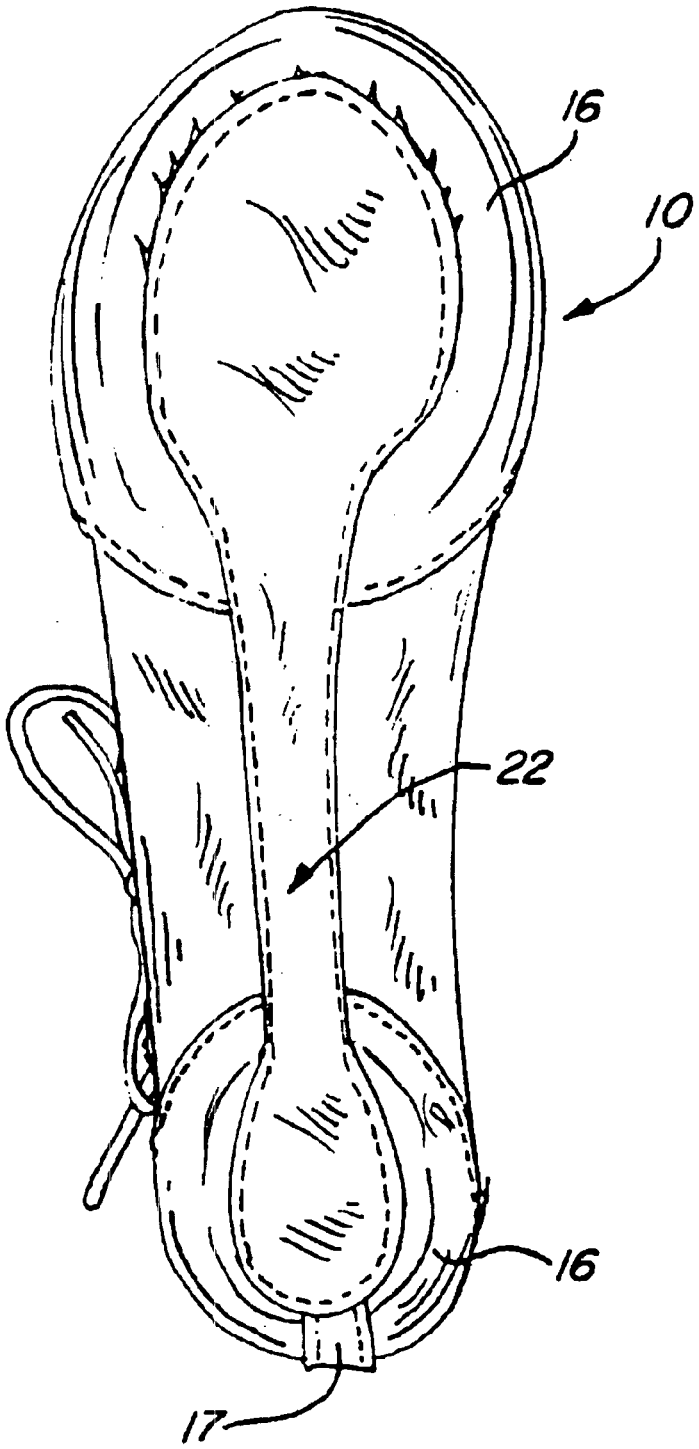
FIG. 4 is a bottom plan view of a substantially pleatless slipper in accordance with another embodiment of the invention having a one-piece outsole.

FIG. 4 is a bottom view of a slipper 10 in accordance with another embodiment of the invention as described above except it has a one-piece outsole 22 instead of a two-piece outsole. In one preferred embodiment, the one piece outsole 22 is a symmetrical shape so that the slipper 10 can be worn on either foot. In another embodiment, the outsole 22 of one slipper is an asymmetric shape adapted for one particular foot, and the outsole of the mating slipper is a mirror image of the asymmetric shape.

Figure 5:
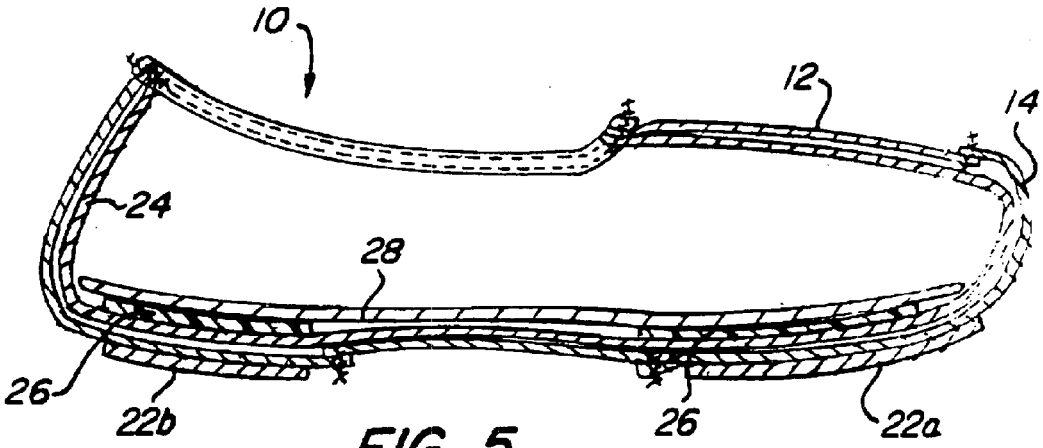
FIG. 5 is a side cross-sectional view of the substantially pleatless slipper of FIG. 1.
Figure 8:
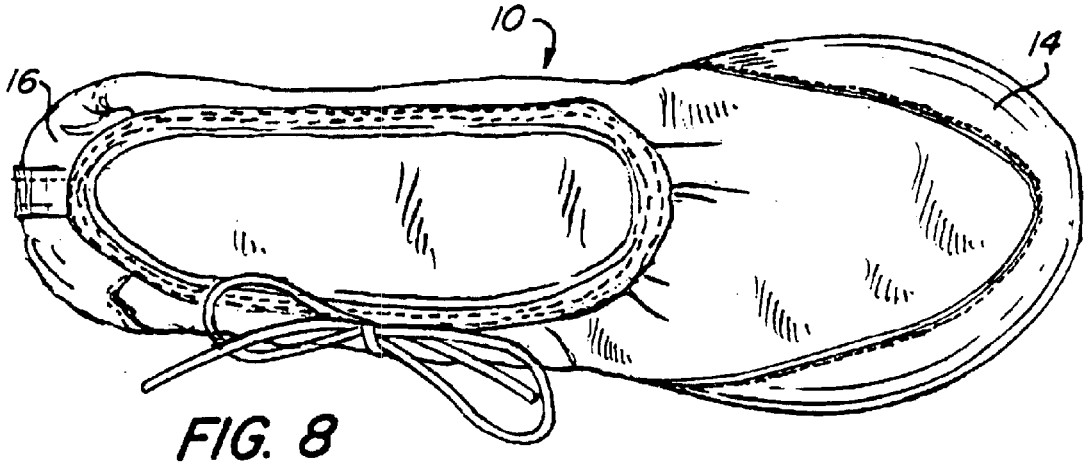
FIG. 8 is a top plan view of the substantially pleatless slipper of FIG. 1

In the preferred embodiment as shown in FIG. 5, a moisture wicking liner 24 is stitched into the interior of the slipper. Also in the preferred embodiment, cushioning pad or pads 26 are provided in the shoe. The cushioning pad may be a one-piece pad, or separate pads, placed particularly in the heel and forefoot areas. Cushioning pads 26 are preferably made of an impact absorbing foam such as Poron® foam. In one embodiment of the invention, the cushioning pads 26 are located in the interior of the shoe, with a sockliner 28 provided over the cushioning pads 26. In another embodiment, the cushioning pads 26 are located on the exterior of the shoe, between the toe piece 14 or heel piece 16 and the outsole 22 (including 22*a* and 22*b*). In such case the sockliner is applied over the moisture wicking liner. In either case, sockliner 28 is made from thin suede, canvas or other suitable material.

Slipper 10 is manufactured by cutting out the desired pieces from the appropriate materials. Toe piece 14 and heel piece 16 are stitched to upper 12. A marginal edge of toe piece 14 is stitched substantially to the outside forefront marginal edge of upper 12 using durable thread such that a second marginal edge of toe piece 14 is located at the sole forefoot. Similarly, marginal edges of heel pieces 16*a* and 16*b* then are stitched to the outside heel marginal edge of upper 12 using durable thread so that an unattached peripheral margin of heel pieces 16*a* and 16*b* is located at the sole heel area.

Upper 12 is joined to itself at the center bottom of the foot along longitudinal seam 13 using durable thread and heel portions 16*a* and 16*b* are stitched to each other along a longitudinal heel seam that is reinforced by stitching heel reinforcing piece 17 substantially over the seam using durable thread.

To affix outsole toe portion 22*a* to toe piece 14, the second marginal edge of toe piece 14 is gathered in substantially even pleats transverse to the marginal edge. Then, a peripheral margin of toe portion 22*a* is stitched and/or glued to toe piece 14 with durable thread so that the toe portion 22*a* substantially covers the bunched together pleats producing a substantially pleatless sole. In one embodiment, the same stitching attaches a peripheral edge of a further backing material, such as cushioning for part of the forefoot area. Outsole heel portion 22*b* is affixed to heel piece 16 by stitching and/or gluing a peripheral margin of heel portion 22*b* to heel piece 16 and over heel reinforcing piece 17. In one embodiment, the same step attaches a peripheral edge of a further backing material, such as cushioning for part of the heel area.

In the case of a one-piece outsole as shown in FIG. 4, outsole 22 is stitched and/or glued to upper 12, and toe and heel pieces 14 and 16. To affix outsole 22 to toe piece 14, the second marginal edge of toe piece 14 is gathered in substantially even pleats transverse to the marginal edge. Then, a proximate peripheral margin of outsole 22 is stitched and/or glued to toe piece 14 with durable thread so that outsole 22 substantially covers the pleats producing a substantially pleatless sole. Outsole 22 is affixed to heel piece 16 by stitching a proximate peripheral margin of outsole 22 to heel piece 16 and over heel reinforcing piece 17. Preferably, outsole 22 is affixed to upper 12 by continuous stitching and/or gluing from either end piece 14 or 16 to the other along a peripheral margin of outsole 22. In one embodiment, the same step attaches a peripheral edge of a further backing material, such as cushioning.

The present invention provides a substantially pleatless ballet slipper suitable for a dancer to use in practice or performance. The ballet slipper of the invention has been found to provide a high degree of comfort and the bunched pleats of the toe piece 14 have been found to be nearly imperceptible to dancers. The feeling that there are no pleats is provided by the unique construction of the ballet slipper, particularly, from the use of an elastic or stretchy, light-weight material, cut into a small, separate toe piece. The elastic or stretchy material conforms the front of the ballet slipper to the dancer's foot and when pulled together beneath the dancer's foot provides on a relatively small amount of bunched together pleats. Traditional all-leather or all-canvas ballet slippers do not have the same degree of stretch fitting to the dancer's foot. As a consequence, the traditional ballet slipper has significantly larger and more noticeable pleats. In addition, the traditional ballet slipper can be provided with only a limited amount of insole, since a full length insole will compromise the fit of the ballet slipper to the dancer's foot and limit her ability to move and control the area at the front of the slipper where the pleats are. In contrast, in the present invention, the particular construction with an elastic or stretchy or stretch fabric in the toe piece permits the use of a cushioning insole, such as cushioning pads 26, which can be placed to lie below the ball and toes of the foot, and the heel of the foot. Such a cushioning insole will cover the small amounts of bunched pleats. This feature, particularly when combined with the outsole which covers the exterior of the bunched or pleated material, makes the pleats virtually imperceptible to the dancer.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A substantially pleatless slipper comprising:

an upper;

a toe piece affixed at a first marginal edge to the upper, the toe piece made of elastic or stretchy material gathered into pleats at a second marginal edge;

a first outsole affixed at a peripheral edge to the toe piece, the outsole covering substantially all pleats of the toe piece;

a heel piece affixed to the upper, wherein the heel piece is made of elastic or stretchy material; and a second outsole, the second outsole affixed at a peripheral edge to the heel piece.

2. The substantially pleatless slipper of claim 1, wherein the first and second outsole are portions of a unitary outsole.

3. The substantially pleatless slipper of claim 1, further comprising:

a liner affixed to an interior of the slipper, the liner being moisture wicking.

4. The substantially pleatless slipper of claim 1, further comprising:

one or more cushioning pads located in an interior of the slipper, said one or more cushioning pads covering said pleats of said toe piece.

5. The substantially pleatless slipper of claim 1, further comprising:

a heel reinforcing piece affixed to the heel piece, the heel reinforcing piece made of elastic or stretchy material.

6. A method of making a substantially pleatless slipper comprising:

providing an upper;

providing a toe piece made of elastic or stretchy material;

affixing the toe piece at a first marginal to the upper;

gathering the toe piece into pleats at a second marginal edge;

providing a first outsole;

affixing the first outsole at a peripheral margin to the toe piece to cover substantially all pleats;

providing a heel piece made of elastic or stretchy material;

affixing the heel piece to the upper;

providing a second outsole; and affixing the second outsole at a peripheral margin to the heel piece.

7. A substantially pleatless ballet slipper, comprising:

an upper formed of a non-elastic material, said upper being shaped to contain a foot, said upper lacking a forefoot portion;

an toe piece formed of an elastic or stretchy material, said toe piece being affixed to said upper to provide a forefoot portion, said forefoot portion having a lower area, said elastic or stretchy material of said toe piece being bunched together in said lower area; and a first outsole affixed to said toe piece and covering substantially all said bunched together material of said toe piece.

8. The substantially pleatless ballet slipper of claim 7, wherein said upper lacks a heel portion, and further comprising:

a heel piece formed of an elastic or stretchy material affixed to said upper to provide a heel portion; and a second outsole affixed to said heel piece.

9. The substantially pleatless ballet slipper of claim 7, wherein said upper lacks a heel portion, and further comprising:

a heel piece formed of an elastic or stretchy material affixed to said upper to provide a heel portion; and said first outsole extends from said toe piece to said heel piece.

10. The substantially pleatless ballet slipper of claim 7, further comprising:

a liner affixed to an interior of the slipper.

11. The substantially pleatless slipper of claim 7, further comprising:

one or more cushioning pads located in an interior of the slipper, said one or more cushioning pads covering said bunched together material of said toe piece.

12. The substantially pleatless slipper of claim 11, further comprising:

a sockliner overlying said one or more cushioning pads.

13. A substantially pleatless ballet slipper, comprising:

an upper formed of a non-elastic material, said upper being shaped to contain a foot, said upper lacking a forefoot portion and a heel portion;

an toe piece formed of an elastic or stretchy material, said toe piece being affixed to said upper to provide a forefoot portion, said forefoot portion having a lower area, said elastic or stretchy material of said toe piece being bunched together in said lower area;

a heel piece formed of an elastic or stretchy material affixed to said upper to provide a heel portion; and one or more outsoles affixed to said toe piece and said heel piece, at least a forward portion of one of said outsoles covering substantially all said bunched together material of said toe piece.

14. The substantially pleatless ballet slipper of claim 13, further comprising:

a liner affixed to an interior of the slipper.

15. The substantially pleatless slipper of claim 14, further comprising:

one or more cushioning pads affixed to the interior of the slipper in at least heel and toe areas of said slipper.

16. The substantially pleatless slipper of claim 15, wherein a cushioning pad is located to cover said bunched together material of said toe piece.

17. The substantially pleatless slipper of claim 15, further comprising: a sockliner overlying said one or more cushioning pads.

* * * * *

UNITED STATES PATENT AND TRADEMARK OFFICE

CERTIFICATE OF CORRECTION

PATENT NO. : 6,857,203 B2
APPLICATION NO. : 10/270909
DATED : February 22, 2005
INVENTOR(S) : Elizabeth Gaynor Minden It is certified that error appears in the above-identified patent and that said Letters Patent is hereby corrected as shown below:

On the Cover Page, at (73), delete "Assignee: Gloria Minden, Inc., New York, NY (US)"

Signed and Sealed this

Fifth Day of May, 2009

John Doll

JOHN DOLL
*Acting Director of the United States Patent and Trademark Office*